United States Patent [19]

Rabinowitz et al.

[11] Patent Number: 4,487,996

[45] Date of Patent: Dec. 11, 1984

[54] SHIELDED ELECTRICAL CABLE

[75] Inventors: Mario Rabinowitz, Redwood City; E. Robert Perry, Portola Valley, both of Calif.

[73] Assignee: Electric Power Research Institute, Inc., Palo Alto, Calif.

[21] Appl. No.: 446,193

[22] Filed: Dec. 2, 1982

[51] Int. Cl.[3] ..... H01B 9/02

[52] U.S. Cl. ..... 174/105 R; 174/105 SC; 174/106 SC

[58] Field of Search ..... 174/36, 102 SC, 105 R, 174/105 SC, 106 SC, 120 SC, 110 R, 110 SR, 120 SR

[56] References Cited

U.S. PATENT DOCUMENTS

| | | | |
|---|---|---|---|
| Re. 30,228 | 3/1980 | Silver et al. | 174/36 |
| 2,131,478 | 3/1937 | Mann | 171/95 |
| 2,165,738 | 7/1939 | Van Hoffen | 174/102 SC X |
| 2,260,845 | 10/1941 | Urmston | 174/105 |
| 2,304,210 | 12/1942 | Scott et al. | 174/106 SC |
| 3,088,995 | 5/1963 | Baldwin | 174/36 |
| 3,617,377 | 11/1971 | Isshiki et al. | 174/105 R |
| 3,643,004 | 2/1972 | McKean | 174/105 SC X |
| 3,666,876 | 5/1972 | Forster | 174/36 |
| 3,683,309 | 8/1972 | Hirose | 338/214 |
| 3,749,817 | 7/1973 | Shiga et al. | 174/102 SC |
| 3,780,206 | 12/1973 | Reynolds | 174/36 |
| 3,792,192 | 2/1974 | Plate | 174/102 |
| 3,828,115 | 9/1974 | Hvizd, Jr. | 174/73 |
| 3,885,085 | 5/1975 | Bahder et al. | 174/36 |
| 4,008,367 | 2/1977 | Sunderhauf | 174/107 |
| 4,109,098 | 8/1978 | Olsson et al. | 174/120 SC X |
| 4,143,238 | 3/1979 | Sheth | 174/107 |
| 4,303,733 | 12/1981 | Bulle et al. | 428/367 |
| 4,342,880 | 8/1982 | Castelli et al. | 174/105 SC X |
| 4,360,706 | 11/1982 | Lanfranconi et al. | 174/120 SC X |

OTHER PUBLICATIONS

"New Plastics That Carry Electricity", *Newsweek*, Jun. 18, 1979, pp. 77–77A.

Epstein, Arthur J. and Miller, Joel S., "Linear-Chain Conductors", *Scientific American*, Oct. 1979, pp. 52–61.

*Primary Examiner*—John Gonzales
*Assistant Examiner*—Morris H. Nimmo
*Attorney, Agent, or Firm*—Flehr, Hohbach, Test, Albritton & Herbert

[57] ABSTRACT

An electrical coaxial cable is disclosed herein including an inner conductor and a concentric outer conductor electrically insulated from one another by means of a layer of dielectric material disposed therebetween. A series of concentric layers of electrically conductive polymer material serve to shield the insulation layer from the inner and outer conductors and also divide the insulation layer into individual concentric segments.

3 Claims, 2 Drawing Figures

SHIELDED ELECTRICAL CABLE

Figure 1:
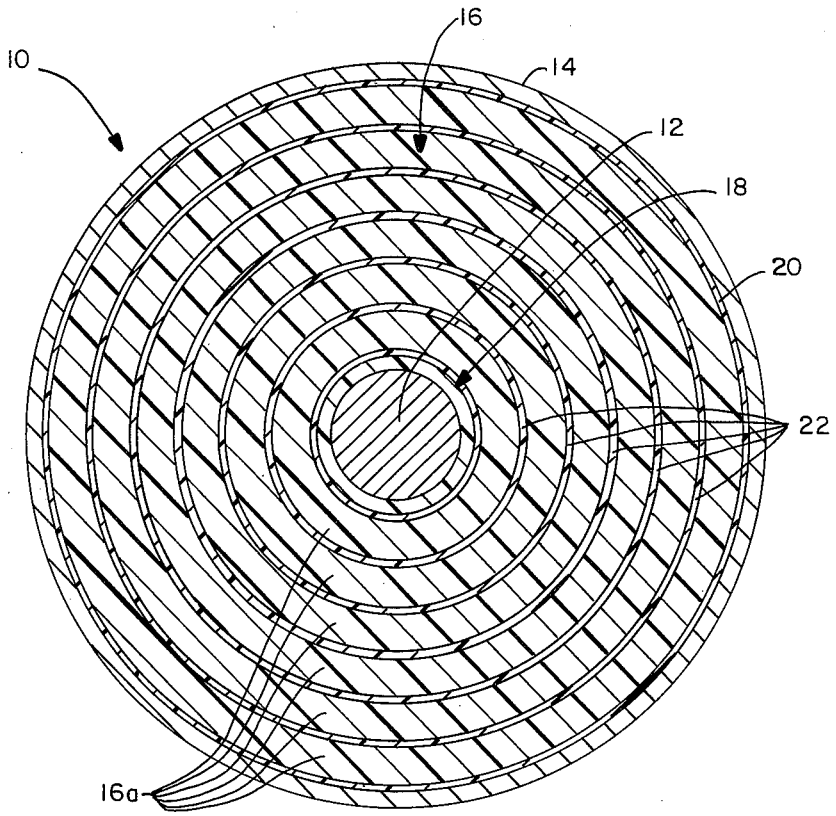

The present invention relates generally to electrical cable, for example coaxial cable utilized for transmission and distribution service, and more particularly to the use of semi-conductive shields with such cable.

Coaxial transmission and distribution cables of the type just mentioned typically include concentric inner and outer bendable or flexible conductors insulated from one another by a suitable bendable or flexible dielectric material, for example cross-linked polyethylene. Because the conductors are generally formed from strands and therefore not smooth, relatively high, non-uniform electric fields result at the interface between the respective conductors and the adjacent dielectric insulation. Heretofore, in order to reduce and make more uniform these resultant fields, semiconductive shields have been used. Typically, one shield is placed between the outer surface of the inner conductor and the inner suface of the dielectric insulation and a second shield is placed between the outer surface of the insulation and the inner surface of the outer conductor.

Applicants have found the utilization of shields to be quite important in cable of the type described. However, the particular material, specifically carbon particles embedded in cross-linked polyethylene, heretofore used in forming these shields has been found to be less than satisfactory. Because the conductive component of the shield is made up of discrete particles, specifically the carbon, rather than being continuous throughout its extent, internal electric fields result within the shield. At the same time, the particulate carbon tends to protrude into the dielectric layer at its interface with the shield, thereby causing electric fields to be produced within the dielectric layer. In both cases, the presence of these electric fields decreases the dielectric strength of the cable and accelerates the time deterioration of its performance.

In view of the foregoing, it is an object of the present invention to provide a way of eliminating the problems just recited in an uncomplicated and yet reliable way. As will be seen hereinafter, this is achieved in accordance with the present invention by placing a specific type of shield between the conductor and its adjacent layer of dielectric material. This shield is formed of an electrically conductive material which is (i) sufficiently electrically conductive throughout its extent (e.g. continuously) to substantially eliminate the presence of any internal electric fields, (ii) sufficiently smooth at its interface with the layer of dielectric material to substantially prevent electric field enhancement within that layer, and (iii) sufficiently yieldable to bend with the rest of the cable without breaking, tearing or even wrinkling.

In a preferred embodiment of the present invention, the material forming the shield is an electrically conductive polymer which has the advantage of being continuous in its electrical conductivity and smooth at its interface with the dielectric material. At the same time, the conductive polymer is sufficiently yieldable to bend with the rest of the cable without breaking. This latter feature is to be contrasted with the more rigid characteristics of metal which might otherwise be suitable as a shield since it is continuous (electrically) and, at the same time, can be made smooth along its outer surfaces.

In the case of coaxial cable having inner and outer concentric conductors insulated from one another by a central layer of dielectric material, it is desirable to utilize a number of shields formed from conductive polymer. One such shield is disposed directly between the inner conductor and the insulation layer while a second shield is disposed between the outer conductor and the insulation layer. At the same time, in accordance with another feature of the present invention, the insulation layer itself is divided into a number of thinner concentric segments by additional shields formed from the same conductive polymer. This has a numbr of advantages to be discussed hereinafter.

Figure 2:
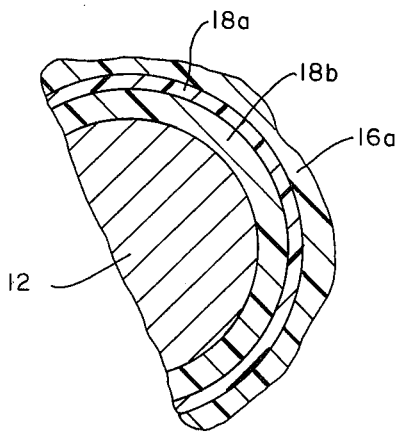

The overall cable incorporating the present invention will be described in more detail hereinafter in conjunction with the drawing wherein:

FIG. 1 is a cross-sectional view of a coaxial cable including an arrangement of shields provided in accordance with the present invention; and FIG. 2 is an enlarged view of a portion of the cable illustrated in FIG. 1 and specifically illustrating a particular feature of the latter.

Turning now to the drawings, attention is first directed to FIG. 1 which illustrates a coaxial cable generally designated by the reference numeral 10. The particular cable shown is intended for use in transmission and distribution service but may be of any other type without departing from the present invention. Like many cables, coaxial cable 10 includes an innermost conductor 12 constructed of copper, aluminum or like highly electrically conductive and bendable or flexible material, a concentric outermost conductor 14 constructed of the same or similar material and a layer of bendable or flexible dielectric material 16 disposed between the two conductors for electrically insulating them from one another. The dielectric material is of any suitable type such as cross-linked polyethylene.

As illustrated in FIG. 1, coaxial cable 10 includes an innermost shield 18 disposed directly around conductor 12 between the latter and the innermost surface of insulation layer 16. An outermost shield 20 is disposed around the outer surface of the insulation layer between the latter and the inner surface of conductor 14. In accordance with the present invention, each of these shields is sufficiently electrically conductive throughout its extent to substantially eliminate the presence of any internal electric fields and, at the same time, it is sufficiently smooth at its interface with the insulation layer 16 so as not to cause the production of electric fields within the insulation. In addition, each shield is sufficiently yieldable to bend with the rest of the cable without breaking.

A specific material meeting all of the requirements just recited is any one of a number of conductive polymers including specifically polyacetylene, polyparaphenylene, anthrone polymers, polypyrrole, and poly-p-phenylene sulfide. With proper doping, such as with $AsF_5$, bromine or the like, the conductivity of these various polymers can be made to range over orders of magnitude. For example, the electrical conductivity of polyacetylene, $(CH)_x$, can be made to range over 12 orders of magnitude. Its resistivity can routinely be tailored from $10^{13}$ ohm-cm to $10^{-3}$ ohm-cm. On the other hand, for purposes of the present invention, many of the conductive polymers such as polyacetylene have sufficient conductivity without any doping.

Depending upon the conductive polymer selected, it may be that a shield consisting solely of that copolymer is too thin to be reliably positioned around the innermost conductor 12. Under this circumstance, the innermost shield 18 could be comprised of a thin conductive polymer layer 18*a* supported on a more structurally sound layer 18*b* of highly carbon filled dielectric material such as cross-linked polyethylene, polyethylene, polypropylene or the like. In this case, the carbon filled dielectric layer would be disposed directly adjacent the innermost conductor and the conductive polymer would be located directly against the innermost surface of the insulation layer. While it is true that this particular approach would not eliminate the production of internal electric fields within the support layer, it would prevent the innermost shield from causing highly concentrated electric fields to be produced within the insulation near the interface. Of course, it would be preferable not to have to use the carbon filled dielectric layer at all. In the case of outermost shield 20, the latter can be formed in the same way as the inner shield from the standpoint of structural integrity.

Cable 10 is not only shown including an innermost shield 18 and an outermost shield 20 on opposite sides of insulation layer 16 but also includes additional concentric, conductive polymer shields 22 radially spaced from one another between the shields 18 and 20 whereby to divide the insulation layer into a plurality of concentric segments 16*a*. These thinner individual segments have been found to display an overall dielectric strength which is greater than the insulation layer would display if not divided into segments. In other words, each individual segment has been found to contribute a greater amount of dielectric strength as a result of being isolated by the shields than it would in the absence of these shields. At the same time, the shields confine any field perturbations to local regions. In the absence of the shields, these field perturbations would tend to extend across the cable. The shields inhibit tree growth and corona discharges from traversing the entire cable. Finally, by dividing the insulation layer into thinner individual segments, these individual segments are easier to make void free than possible by making the entire layer without such segments.

While overall cable 10 has been illustrated as a coaxial cable including inner and outer conductors and a layer of insulation therebetween, it is to be understood that the present invention is not limited to this particular configuration. Even single conductor cable, e.g. cable having only an innermost conductor surrounded by a layer of insulation, would benefit from the present invention. In this latter case, only the inner shield 18 would be necessary, although the outermost insulation layer could be divided into segments in the same manner as insulation layer 16.

What is claimed is:

1. An electrical coaxial cable including an inner conductor, a radially spaced concentric outer conductor and a concentric layer of dielectric material disposed between said inner and outer conductors for electrically insulating the two from one another, the improvement comprising the inclusion of at least three coaxial shields, an innermost one of which is located between the outermost surface of said inner conductor and the innermost surface of said dielectric layer, a second one of which is located between the outermost surface of said dielectric layer and the innermost surface of said outer conductor and the remaining shield or shields being disposed within said dielectric layer so as to divide it up into individual, thinner circumferential segments which together display a higher dielectric strength than the overall dielectric layer would display if it remained unsegmented, said remaining shields also serving to confine any electric field perturbation and/or corona discharge in any particular segment of said dielectric material to that segment, each of said shields being formed of an electrically conductive, bendable polymer which is continuously electrically conductive throughout its extent so as to substantially eliminate the presence of any internal electric fields and smooth at their interfaces with said dielectric material so as to substantially prevent electric field enhancement within the dielectric material, the innermost one of said shields being supported on a layer of dielectric material which is highly filled with carbon particles and which is disposed between said innermost shield and said inner conductor.

2. An electrical cable including a bendable conductor surrounded by an adjacent, bendable layer of dielectric material for electrically insulating said conductor, the improvement comprising the inclusion of a circumferential shield between said conductor and layer of dielectric material, said shield being formed of an electrically conductive material which is (i) continuously electrically conductive throughout its extent so as to substantially eliminate the presence of any internal electrical fields, (ii) smooth at its interface with said layer of dielectric material so as to substantially prevent electric field enhancement within said layer, and (iii) bendable with the rest of the cable without breaking, tearing or wrinkling, said shield being formed from an electrically conductive polymer selected from the group consisting of polyacetylene, polyparaphenylene, and polypyrrole.

3. An electrical coaxial cable including an inner conductor, a radially spaced concentric outer conductor and a concentric layer of dielectric material disposed between said inner and outer conductors for electrically insulating the two from one another, the improvement comprising the inclusion of at least three coaxial shields, an innermost one of which is located between the outermost surface of said inner conductor and the innermost surface of said dielectric layer, a second one of which is located between the outermost surface of said dielectric layer and the innermost surface of said outer conductor and the remaining shield or shields being disposed within said dielectric layer so as to divide it up into individual, thinner circumferential segments, each of said shields being formed of an electrically conductive polymer which is continuously electrically conductive throughout its extent so as to substantially eliminate the presence of any internal electric fields and smooth at their interfaces with said dielectric material so as to substantially prevent electric field enhancement within the dielectric material, said electrically conductive polymer being selected from the group consisting of polyacetylene, polyparaphenylene, and polypyrrole.

* * * * *